US005885049A

United States Patent [19]

McNeilus et al.

[11] Patent Number: 5,885,049

[45] Date of Patent: Mar. 23, 1999

[54] EJECTION MECHANISM FOR REFUSE TRUCKS

[75] Inventors: Garwin B. McNeilus, Dodge Center; Wilbur R. Harris, Rochester, both of Minn.

[73] Assignee: McNeilus Truck and Manufacturing, Inc., Dodge Center, Minn.

[21] Appl. No.: 902,667

[22] Filed: Jul. 30, 1997

[51] Int. Cl.[6] ..... B65F 3/20

[52] U.S. Cl. ..... 414/512; 414/517; 414/525.6

[58] Field of Search ..... 414/510, 511, 414/512, 513, 516, 517, 521, 525.2, 525.6; 100/187, 220, 269.2

[56] References Cited

U.S. PATENT DOCUMENTS

| | | | |
|---|---|---|---|
| 3,211,309 | 10/1965 | Shubin | 414/525.6 |
| 4,264,261 | 4/1981 | Brisson | 414/517 |
| 4,271,756 | 6/1981 | Bettencourt | 414/525.2 X |
| 4,544,320 | 10/1985 | Haines | 414/511 |
| 5,316,430 | 5/1994 | Horning et al. | 414/407 |
| 5,484,246 | 1/1996 | Horning et al. | 414/409 |
| 5,740,726 | 4/1998 | Schwelling | 100/220 |
| 5,785,487 | 7/1998 | McNeilus et al. | 414/517 |

FOREIGN PATENT DOCUMENTS

| | | | |
|---|---|---|---|
| 1239977 | 7/1988 | Canada | 414/517 |
| 2262288 | 6/1974 | Germany | 414/525.6 |
| 3447814 | 7/1986 | Germany | 414/517 |
| 2137955 | 10/1984 | United Kingdom | 414/517 |
| 91104206 | 4/1991 | WIPO | 414/517 |

*Primary Examiner*—James W. Keenan

*Attorney, Agent, or Firm*—Nikolai, Mersereau and Dietz, P.A.

[57] ABSTRACT

An ejection assisting device is provided in a material handling apparatus for handling refuse or recyclables relative to a collection vehicle to dislodge material not discharged by gravity in a gravity induced material unloading system.

9 Claims, 6 Drawing Sheets

EJECTION MECHANISM FOR REFUSE TRUCKS

BACKGROUND OF THE INVENTION

I. Field of the Invention

This invention relates generally to material collection vehicles and those vehicles having divided storage bodies and to a loading system including a packing apparatus for charging refuse or recyclables into distinct predetermined storage body compartments in such a multi-compartment collection vehicle, which compartments are further emptied by opening tailgates and tilting the truck body by raising the front of the truck body and producing a dump position. More particularly, this invention relates to an ejection system that assists the gravity induced tilt dumping operation by dislodging material in areas where obstructions might occur. The system typically operates in conjunction with a receiving and packing apparatus having a divided charging hopper wherein dual linear-operating packing panels, each operating within a divided portion of the charging hopper, charge the refuse or recyclables into an associated compartment of the storage body wherein the more remote portion of one storage body compartment is of smaller cross section than the associated charging hopper. In a vertically divided system, the charging hopper and storage body are typically divided using a lowered horizontal separator and an inclined ramp floor segment in the upper storage compartment so as to increase the relative holding capacity of the upper portion of the charging hopper, without significantly decreasing the holding capacity of the lower storage compartment.

II. Discussion of the Related Art

Refuse collection vehicles of the conventional variety generally include a storage compartment, a charging hopper, a loading mechanism, and a compacting mechanism all mounted on the vehicle. If the loading mechanism is of the front or side loading variety, the loading mechanism operates to engage, lift, and empty a container of interest into the open top of an associated charging hopper and the compacting mechanism directs the material from front to rear. When separated waste materials are hauled in designated compartments of the storage body of the collection vehicle, it is desirable to separately compact the material stowed in each compartment to allow a greater volume of material to be hauled.

The charging hopper typically includes a ram or packer panel which operates to pack refuse or recyclable material into the storage compartment. A partitioned charging hopper of a multi-compartment collection vehicle typically has an upper loading hopper separated by a floor and forward wall, and a separate packing system that is operated independently of that of the lower loading hopper. The wall is normally a transverse vertical member that provides a rigid dividing wall that divides the receiving opening or access to the upper hopper (rear) from that of the lower hopper (front).

A divided side loading bucket or top (front loading) tipping device may be used to load segregated, collected materials into the predetermined portions of the charging hopper. When refuse is dumped into the hopper of the vehicle, the rearward portion of refuse contained in the loading bucket may land in the access to the upper hopper and the forward portion is received in the lower hopper. The loading bucket is typically divided or split fore and aft so that a first dedicated portion dumps into the lower hopper and a second dedicated portion dumps into the upper hopper.

A representative example of such a collection vehicle appears in U.S. Pat. No. 5,316,430, issued to Horning et al., which describes a divided vehicle for collecting, hauling, and delivering recyclable materials. The vehicle includes a divided charging hopper having a packer panel associated with the upper portion of the divided charging hopper. A double acting packing cylinder pushes and pulls or reciprocates the packer panel between a forward and aft position. The packing cylinder extends into and through the opening to the lower divided portion requiring material being loaded into the lower portion of the charging hopper to spill over the packing cylinders eventually reducing their useful life.

U.S. Pat. No. 5,484,246 also issued to Horning et al. discloses a similarly divided upper and lower charging hopper compartment. The upper portion of the charging hopper includes a ram that encloses a longitudinally extending packing cylinder. While this avoids exposing the cylinders to corroding refuse, it significantly reduces the holding capacity of the upper portion of the charging hopper.

An improved packing apparatus adapted for receiving and charging refuse or recyclables into preselected storage compartments of a multi-compartment collection vehicle having a multi-compartment storage body mounted to the vehicle and extending longitudinally therealong is fully described in copending application Ser. No. 08/748,649, filed Nov. 14, 1996 and common of inventorship and assignee and which is hereby incorporated by reference in its entirety for any purpose. That system generally includes a divided charging hopper, first and second packers, and first and second means for linearly displacing the corresponding first and second packers.

A loading mechanism of either side loading (grabber or bucket) variety may be attached in communication with the charging hopper and adapted to load the refuse or recyclables into the charging hopper of the packing apparatus. The operation of a side loading bucket is described in greater detail in co-pending application Ser. No. 08/596,731, filed Feb. 5, 1996 now abandoned, and assigned to the same assignee as the present application, the entire disclosure of which is also incorporated herein by reference.

The charging hopper is mountable to the collection vehicle forward of the multi-compartment storage body and adapted to receive material and to charge material into a preselected compartment of the multi-compartment storage body of the vehicle. The charging hopper includes a transverse dividing wall and floor which divide the charging hopper into an upper and lower portion. The upper portion of the multi-compartment charging hopper includes a dropped floor, the storage body having a ramped transition connecting the charging hopper dividing floor, and the floor of the upper storage body compartment, wherein material loaded into the upper portion of the charging hopper is moved up the ramped or sloped floor and into the upper compartment of the storage body. The ramped floor allows the charging hopper dividing floor to be positioned lower relative to the top opening of the charging hopper, thereby generously increasing the holding capacity within the upper portion of the charging hopper.

Separate packer mechanisms are positioned within the lower and upper portions of the charging hopper respectively. Each packer is repeatably linearly displaceable between a stowed and packing position for sequentially packing materials into the corresponding compartment of the multi-compartment storage body.

A side loading grabber mechanism is described in greater detail in co-pending application Ser. No. 08/596,648, filed Feb. 5, 1996, now U.S. Pat. No. 5,720,589, and assigned to the same assignee as the present application, the entire disclosure of which is also incorporated herein by reference. Of course, other mechanisms including front loading mechanisms of known construction may replace the side loading bucket or grabber and the width of the charging hopper adjusted accordingly.

The dropped floor of the upper section of the charging hopper greatly facilitates loading, particularly where the like amounts are charged, both fore and aft, i.e., into both the upper and lower charging hopper compartments. This allows successful optimization of available charging hopper volume without increasing the height of the vehicle to accommodate additional material in the top section. A limitation of this configuration, however, results from the ramping of the floor into the upper storage compartment which, in effect, results in a necking down or reduced cross sectional area producing a constriction of the material moved in from the charging hopper. From time to time, this may result in jamming or difficulty in emptying the upper compartment when the load is dumped by gravity by tilting the vehicle body at the landfill or other receiving site. Accordingly, there remains a need for a device which positively keeps the transition area cleared to prevent clogging during discharge of the load.

SUMMARY OF INVENTION

The present invention solves the above problem by providing an ejection assisting device or mechanism compatible with virtually any front or side loading, rear gravity discharge refuse truck not equipped with a full stroke or sweep ejector system. The ejector device of the invention will alleviate the clogging of the refuse storage compartments thereby assuring complete discharge when the body is raised for gravity discharge and emptying. The system is particularly adapted to storage compartments associated with or charged by an enlarged or dropped floor charging hopper which may lead into a storage area partially of reduced cross section relative to the adjacent charging hopper compartment and which thereby creates a necked-down passage beyond the range of the packing ram which, once clogged, will resist gravity discharge when the truck body is tipped to be emptied.

The system of the invention includes a reciprocating linearly displaceable telescoping tubular section having a pusher or rake device attached to the end thereof for reciprocal movement within the load and being linearly displaceable a sufficient amount to adequately cover areas of possible clogging in the storage compartment which it is used. The preferred embodiment uses an inner tubular section which telescopes from an outer tubular section utilizing an internally mounted double-acting hydraulic cylinder. A rakehead attached to the end of the inner tube and that right angles thereto pushes through the load in the vicinity of possible clogs to free material for gravity ejection. The rakehead may contain a plurality of teeth deployed at right angles to the head and which are fully deployed during the pushout stroke but which fold against the rake as the head is withdrawn and the cylinder retracted. Any desired number of teeth may be used.

The telescoping tubular sections are preferably mounted to one side of the loading hopper so that they do not interfere with other devices in the mechanized collection and packing system but yet allow the pusher to be deployed as needed in the vicinity of possible clogging in the material storage body. The system may be used in conjunction with any side or front loading, rear discharge refuse body where difficulties in gravity discharge of the load may be anticipated.

BRIEF DESCRIPTION OF THE DRAWINGS

In the drawings wherein like reference numerals represent like parts throughout the same.

DETAILED DESCRIPTION

The present invention involves an ejection assist device or mechanism compatible with virtually any front or side loading, rear gravity discharging refuse truck not equipped with a full length or sweep ejector system. The ejector device alleviates clogging of the refuse storage compartments thereby assuring complete discharge when emptied. It is particularly adapted to storage compartments associated with or charged by an enlarged or dropped floor charging hopper which may lead into a storage area of lesser cross section than the adjacent charging hopper compartment which thereby creates a necked-down passage beyond the range of the packing ram which, once clogged, will resist gravity discharge when the truck body is tipped to be emptied. While the illustrative embodiments herein may be expressed in terms of a side loading, dual charging compartment and dual gravity discharge storage compartment arrangement, it will be recognized that the ejection assist device of the present invention can readily manifest itself in other refuse truck arrangements including front loading, rear discharge vehicle bodies.

Figure 1:
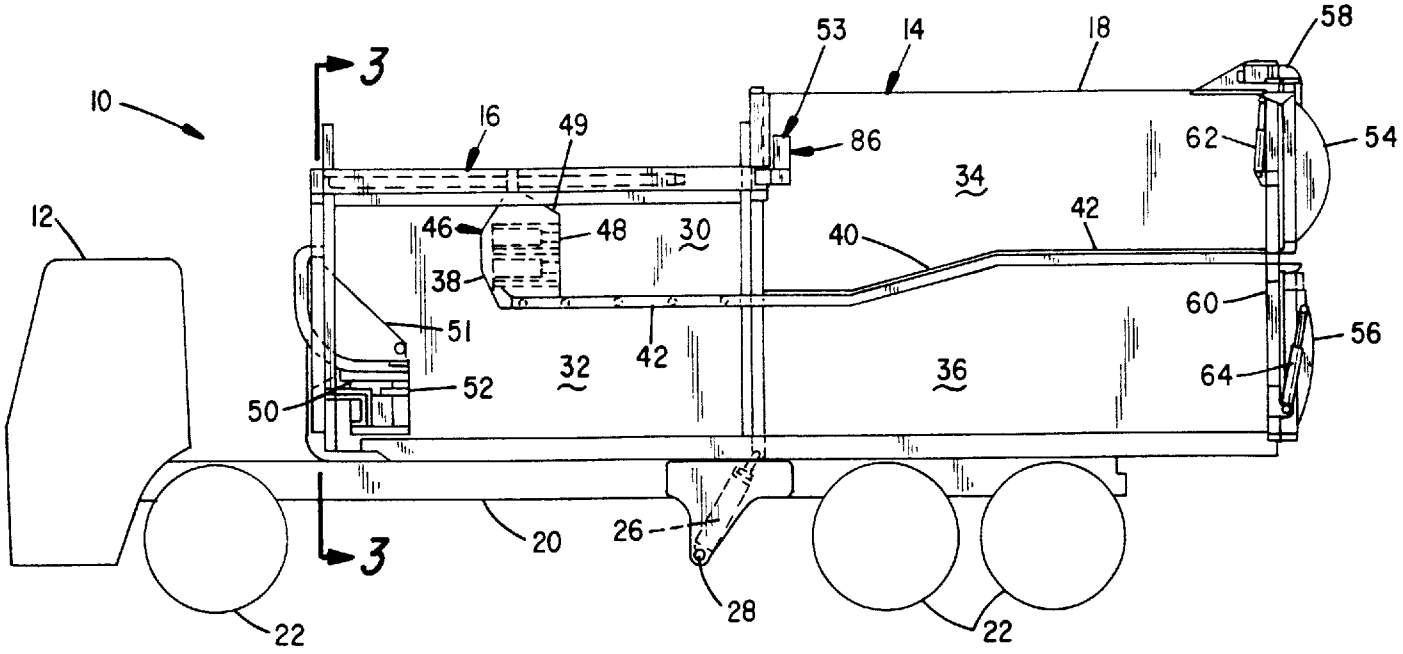
FIG. 1 is a side view of a truck body, parts of which have been removed to expose certain details including the receiving hoppers and packing apparatus and the ejection assist apparatus of the invention mounted in a multiple compartment side loading refuse vehicle body depicted in the loading or transporting position with the compacting and ejection mechanisms in the forward or retractable position.

In FIG. 1, a refuse truck is shown generally at 10 that includes a cab section 12 and a truck body 14 with integral charging hopper 16 and storage area 18 all mounted on a truck chassis 20 carried by a plurality of wheels 22. The truck body 14 is pivotally mounted on the chassis 20 at 24 (FIG. 2) so as to be tipped or raised to discharge materials as by a pair of telescoping cylinders, one of which is shown at 26 pivotally mounted to the chassis at 28.

The charging or loading hopper 16 has a top (not shown) which opens for loading in coordination with the raising of a side loading bucket or container tipper in a well-known manner, the charging hopper is generally divided into upper and lower charging compartments or areas 30 and 32, respectively, which, in turn, connect with respective upper and lower storage volumes or compartments 34 and 36, separation being maintained by a partition or knee wall at 38 and a full width dividing floor 42, ramped at 40, which extends from the charging area through the storage area. The ramp 40 creates a transition between the lowered floor of the upper charging hopper and the rearward or final upper storage volume. An upper packing system is shown at 46 with packing panel 48 and upper follower 49 and a lower packing system at 50 with follower panel 51 and packing panel 52.

The system operates very well with a side loading bucket mechanism described in the aforementioned co-pending application Ser. No. 08/596,731, filed Feb. 5, 1996 now abandoned and assigned to the same assignee as the present application, the entire disclosure of which is incorporated herein by reference for any purpose. An alternate, side loading grabber mechanism is described in greater detail in the aforementioned co-pending application Ser. No. 08/596,648, now U.S. Pat. No. 5,720,589 filed Feb. 5, 1996 and assigned to the same assignee as the present application, the entire disclosure which is also incorporated herein by reference for any purpose. Of course, other mechanisms including front loading mechanisms of known construction may replace the side loading bucket or grabber and the width of the charging hopper adjusted accordingly.

Figure 3:
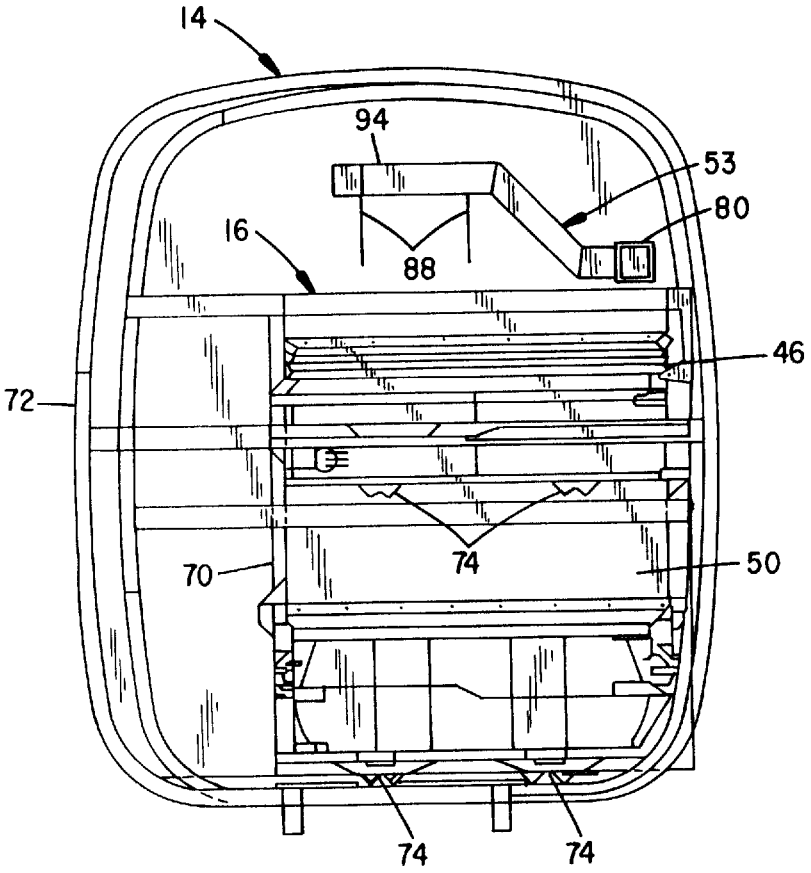
FIG. 3 is a partial cross-sectional view taken along lines 3—3 of FIG. 1.

As shown with particular reference to FIG. 3, the charging hopper is recessed at 70 so that the side loading mechanism may be accommodated next to the charging hopper without extending beyond the width of the truck at 72 when in a stowed position. Each packer system 46 and 50 preferably rides on a friction reducing wear surface system including bottom rails or tracks, guide shoes and wear pads which direct and align the panel as it is displaced between the stowed and packing positions. These are shown as at 74 in FIG. 3. A complete description of such as system including the guide shoes and wear pads suitable for use with the present invention is shown and described in U.S. application Ser. No. 08/717,485, filed on Sep. 20, 1996 now abandoned which is assigned to the same assignee as the present invention, the contents of which are also hereby incorporated by reference in their entirety for any necessary purpose to provide added details of the packer panel, wear shoes or wear pads. It should be noted that the wear shoes and/or wear pads can be made of any suitable self-lubricating polymer or a modified polymer material or of conventional materials including steel, bronze, brass or any combination thereof.

Figure 4:
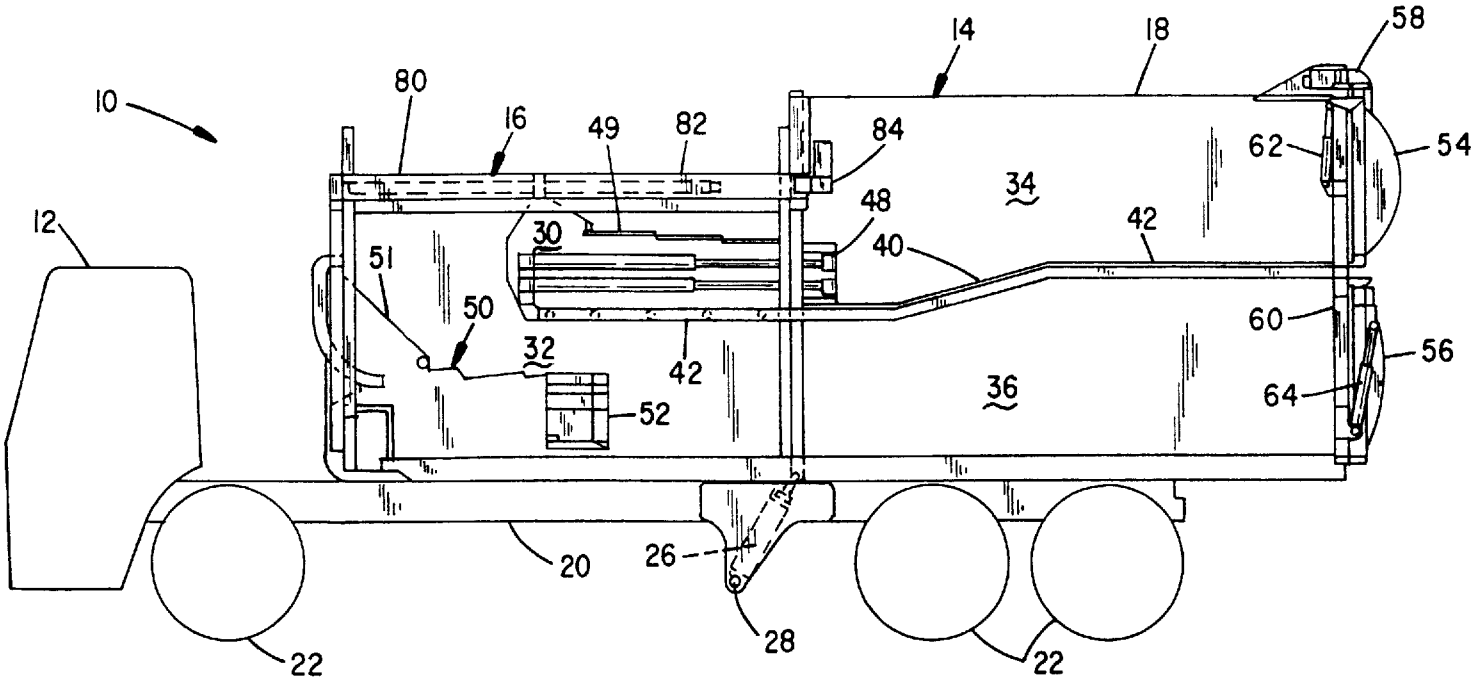
FIG. 4 is a view similar to that of FIG. 1 to illustrate the compacting mechanisms in the fully rearward or packing position.

FIG. 1 depicts the upper and lower packing systems 46 and 50 and the ejector system of the invention in the fully forward positions ready for receiving materials to be dumped into the charging hopper 16. FIG. 4 depicts the system with the compactor panels in the fully rearward or packing position. Note that the upper panel 48 extends only a very short distance into the storage volume 34, a distance shy of the beginning of the upward ramp 40 at 49. In this manner, material is sequentially, systematically and completely packed rearward but the ramp area of reduced cross section is not fully cleared, i.e., there is material compacted before and along the ramp area. This may later result in clogging and failure to fully discharge the load when the truck body is tilted for gravity induced dumping.

Figure 5:
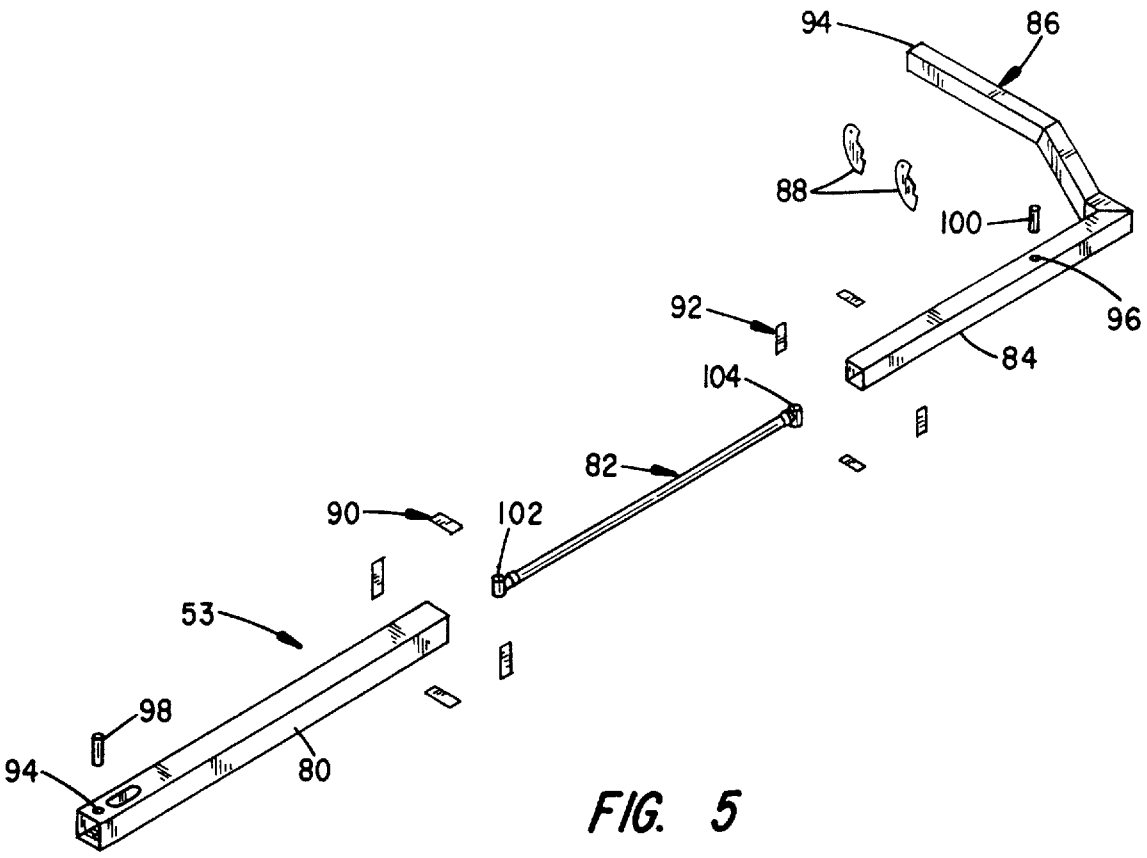
FIG. 5 is an enlarged exploded fragmentary perspective view of the ejection mechanism of the invention.

Accordingly, the ejection assisting system of the present invention is provided which operates reciprocally along an axis parallel to that of the longitudinal axis of the vehicle and truck body to clear the vicinity of the ramp of any residual materials during the dumping operation. As can be seen in the figures, in particularly FIG. 5, the ejection system of the invention includes a main or outer tubular member 80 which houses a double-acting hydraulic or other fluid operated cylinder 82 which reciprocally moves an inner tube 84 which is connected at right angles to a rakehead or ejector head 86 which may carry a plurality of deflectable tines or teeth 88. The inner tube 84 reciprocally telescopes within the outertube 80 using a plurality of sets of friction-reducing wear shoes as at 90 and 92 which may be bolted to the outside of the member 84 or the inside of the member 80 in a well-known manner to ease the reciprocation of the inner tube 84 as it rides in the outer tube 80. As with other wear shoes used in the packing system, the wear shoes can be made of any suitable self-lubricating polymer or a modified polymer or of any conventional materials including steel, bronze, brass or any combination thereof. The cylinder is fastened inside and between the tubes 80 and 84 at 94 and 96 as by using pins as at 98 and 100, respectively, in conjunction with pivotal collars 102 and 104 connected respectively to the cylinder and rod ends of the cylinder 82.

Figure 6:
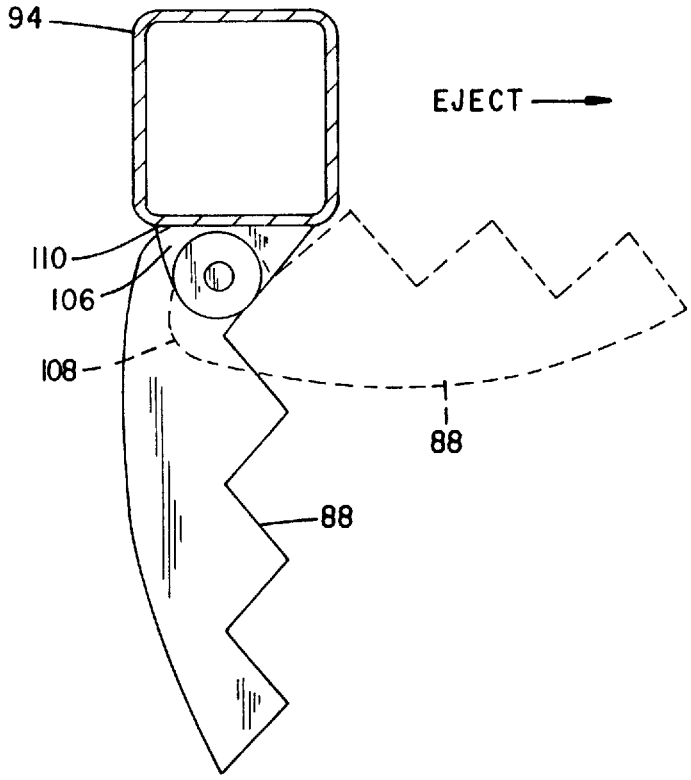
FIG. 6 is a greatly enlarged fragmentary view showing one possible tooth mounting system detail.

As shown best in FIG. 6, the teeth are mounted to rake segment 94 as by a lug 106 in a manner such that the rake teeth 88 may pivot up and out of the way during the return stroke of the ejection mechanism in which the system is retracted but will remain fully extended or deployed during the power or ejection stroke of the ejection assisting system of the invention. In this manner, the teeth may be spring loaded or provided with a cam as at 108 in FIG. 6 which limits its travel by being forced against the side 110 of the tube 94 when the tooth is fully deployed as shown in FIG. 6. The tooth 88 is shown in both positions in FIG. 6, the retracted or folded position being shown in the dash lines.

Figure 2:
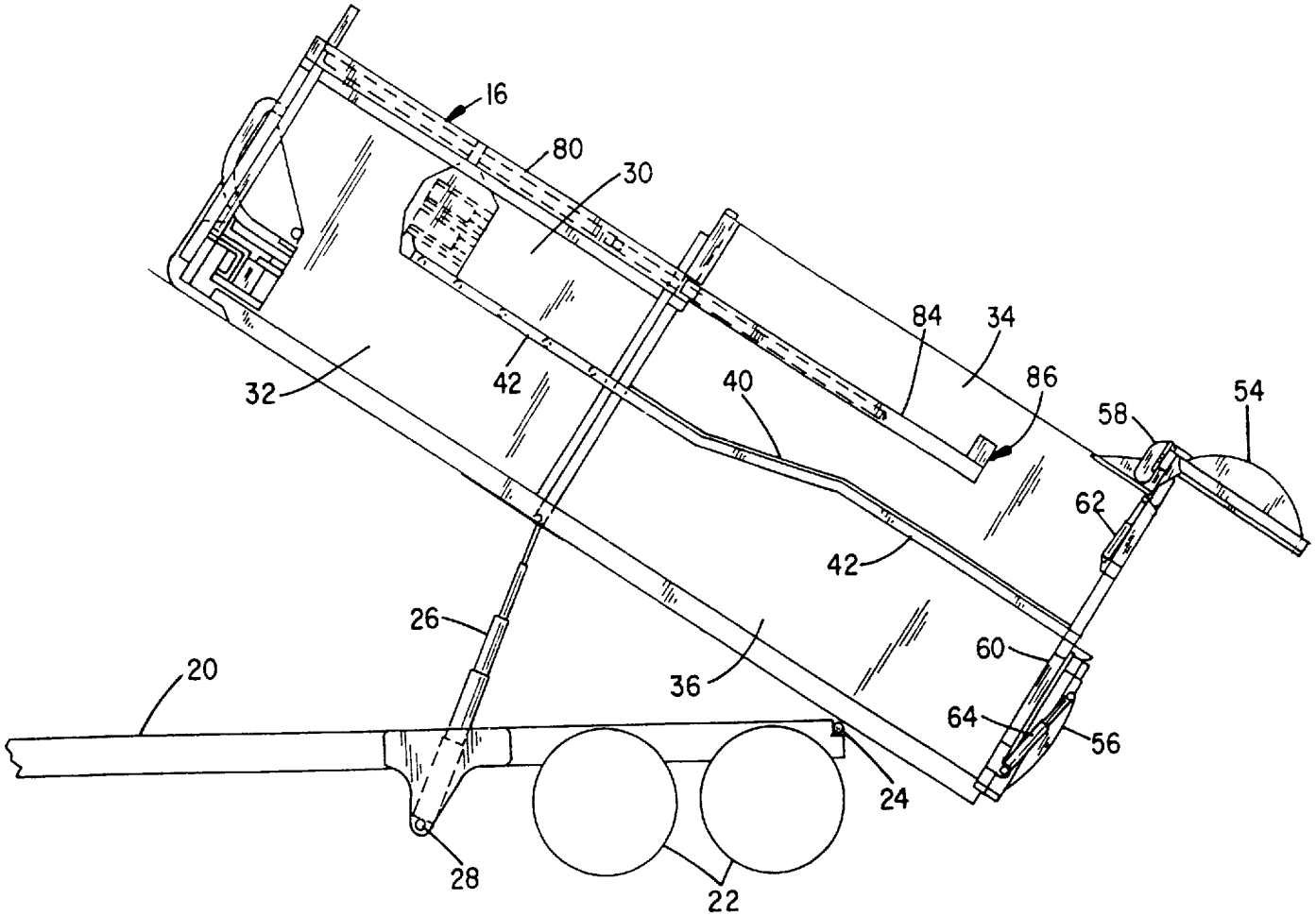
FIG. 2 depicts the truck body of FIG. 1 in the tilted or discharge position with respect to the upper storage compartment shown with the closure door open and the ejection mechanism of the invention extended.

In operation, the ejection system of the invention normally remains in the fully retracted position as depicted in FIGS. 1, 2 and 4 with the cylinder 82 fully retracted and the inner tube 84 retracted into the outer tube 80. Illustrated in FIG. 2, the system is normally activated only in conjunction with discharge or the dumping of the load. The system is shown fully extended with the rake end 86 extending well into the upper storage area 34 thereby clearing the vicinity of the ramped floor section at 40. The system can be repeatedly reciprocally stroked as necessary to fully clear the load from the upper storage area 34 obviating any clogging that might occur due to the reduction in cross sectional area caused by the ramp 40. In this manner, the volume 34 can be readily cleared when it is desired to dump the load. Note that, conversely, the lower storage section 36 enlarges toward the rear of the truck and the ejection assist device generally need not be used in such a situation.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A material handling apparatus for handling refuse or recyclables relative to a collection vehicle, said system including:

(a) a storage compartment mounted on a collection vehicle for tilt-up rear gravity discharge therefrom and having a compartment extending from a charging hopper to a rear discharge opening in which the forward portion located toward the charging hopper has a larger cross sectional area than the rear portion located toward the discharge end and including a transition segment therebetween;

(b) a charging hopper mounted forward of the storage compartment and adapted to charge material into the compartment ahead of said transition segment;

(c) a packer panel positioned within the charging hopper and linearly displaceable between a stowed and a packing position for packing material into said compartment wherein said packer panel does not extend into said transition segment;

(d) a reciprocating ejection assisting mechanism associated with said compartment and said charging hopper, said ejection assisting mechanism being linearly displaceable between a retracted and an ejecting position for clearing material from said transition segment through said rear portion of said storage compartment to assist the gravity discharge therefrom; and (e) wherein said ejection assisting mechanism comprises a transverse pusher attached to a cylinder-operated telescoping tube system, said pusher further comprising a head having plurality of spaced teeth capable of retraction or folding when the ejection assisting mechanism is displaced from an ejecting to a retracted position.

2. The material handling apparatus of claim 1 wherein said teeth further include travel limiting cam means to limit travel on a power stroke to a fully deployed position.

3. The apparatus of claim 1 wherein said cylinder-operated system further comprises an internally mounted double-acting hydraulic cylinder.

4. A refuse receiving, packing and discharging apparatus for receiving and charging refuse or recyclables into a preselected storage compartment of a multi-compartment collection vehicle and discharging same from the preselected storage compartment of a multi-compartment storage body mounted to the vehicle and extending longitudinally therealong, wherein a loading mechanism loads the refuse or recyclables into a charging hopper of a packing apparatus comprising:

(a) a charging hopper having a dividing wall and floor separating the charging hopper into an upper and a lower portion, wherein the charging hopper is mountable to the collection vehicle forward of the multi-compartment storage body and adapted to charge material into a preselected compartment of the multi-compartment storage body, said multi-compartment storage body also having an upper compartment and a lower compartment, wherein said upper compartment of the multi-compartment storage body includes a floor having a ramped transition section between the upper portion of the charging hopper and a major portion of the storage body, wherein material loaded into said upper portion of the charging hopper is moved up said ramped floor and into said major portion of said storage body, such that the ramped floor enables a larger holding capacity within the upper portion of the charging hopper;

(b) a first packer panel positioned within the lower portion of the charging hopper and linearly displaceable between a stowed and a packing position for packing materials into a lower compartment of the multi-compartment storage body;

(c) a second packer panel positioned within the upper portion of the charging hopper and linearly displaceable between a stowed and a packing position for packing materials into an upper compartment of the multi-compartment storage body wherein said second packer panel does not extend into the ramped transition section; and (d) a reciprocating ejection assisting mechanism for propelling material past the ramped transition to assist in the gravity discharge thereof.

5. The material handling apparatus of claim 4 wherein said ejection assisting mechanism comprises a pusher attached to a cylinder-operated telescoping tube system.

6. The material handling apparatus of claim 5 wherein said pusher further comprises a head having plurality of spaced teeth capable of retraction or folding when the ejection assisting mechanism is displaced from an ejecting to a stowed position.

7. The material handling apparatus of claim 6 wherein said teeth further include travel limiting cam means to limit travel on a power stroke to a fully deployed position.

8. The apparatus of claim 6 wherein said cylinder-operated system further comprises an internally mounted double-acting hydraulic cylinder.

9. A material handling apparatus for handling refuse or recyclables relative to a collection vehicle, said system including:

(a) a storage compartment mounted on a collection vehicle for tilt-up rear gravity discharge therefrom and having a compartment extending from a charging hopper to a rear discharge opening in which the forward portion located toward the charging hopper has a larger cross sectional area than the rear portion located toward the discharge end and including a transition segment therebetween;

(b) a charging hopper mounted forward of the storage compartment and adapted to charge material into the compartment ahead of said transition segment;

(c) a packer panel positioned within the charging hopper and linearly displaceable between a stowed and a packing position for packing material into said compartment wherein said packer panel does not extend into said transition segment;

(d) a reciprocating ejection assisting mechanism associated with said compartment and said charging hopper, said ejection assisting mechanism being linearly displaceable between a retracted and an ejecting position for clearing jammed material from said transition segment through said rear portion of said storage compartment to assist the gravity discharge therefrom; and (e) wherein said ejection assisting mechanism comprises a transverse tubular pusher attached to a cylinder-operated telescoping tube system.

* * * * *